US011070912B2

(12) United States Patent
Mehra et al.

(10) Patent No.: US 11,070,912 B2
(45) Date of Patent: Jul. 20, 2021

(54) AUDIO SYSTEM FOR DYNAMIC DETERMINATION OF PERSONALIZED ACOUSTIC TRANSFER FUNCTIONS

(71) Applicant: Facebook Technologies, LLC, Menlo Park, CA (US)

(72) Inventors: Ravish Mehra, Redmond, WA (US); Antonio John Miller, Sammamish, WA (US); Vladimir Tourbabin, Sammamish, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/015,879

(22) Filed: Jun. 22, 2018

(65) Prior Publication Data

US 2019/0394564 A1 Dec. 26, 2019

(51) Int. Cl.

| | |
|---|---|
| ***H04R 3/00*** | (2006.01) |
| ***H04S 7/00*** | (2006.01) |
| ***H04R 1/40*** | (2006.01) |
| ***H04R 5/027*** | (2006.01) |
| ***H04R 1/02*** | (2006.01) |

(52) U.S. Cl.

CPC ..... *H04R 3/005* (2013.01); *H04R 1/028* (2013.01); *H04R 1/406* (2013.01); *H04R 5/027* (2013.01); *H04S 7/30* (2013.01); *H04R 2201/401* (2013.01); *H04S 2400/15* (2013.01); *H04S 2420/01* (2013.01)

(58) Field of Classification Search

CPC ..... H04R 3/005; H04R 1/028; H04R 1/406; H04R 2201/401; H04R 5/027; H04S 7/30; H04S 2400/15; H04S 2420/01

USPC ..... 381/92

See application file for complete search history.

(56) References Cited

U.S. PATENT DOCUMENTS

2014/0185847 A1* 7/2014 Gran ..... H04R 25/407 381/313
2014/0369537 A1* 12/2014 Pontoppidan ..... H04R 25/00 381/314

(Continued)

FOREIGN PATENT DOCUMENTS

CN 103916806 A 7/2014
CN 104244157 A 12/2014

(Continued)

OTHER PUBLICATIONS

The State Intellectual Property Office of People's Republic of China, Office Action, Chinese Patent Application No. 201910424046.9, dated Sep. 27, 2020, 19 pages.

*Primary Examiner* — Vivian C Chin
*Assistant Examiner* — Douglas J Suthers
(74) *Attorney, Agent, or Firm* — Fenwick & West LLP

(57) ABSTRACT

An eyewear device includes an audio system. In one embodiment, the audio system includes a microphone array that includes a plurality of acoustic sensors. Each acoustic sensor is configured to detect sounds within a local area surrounding the microphone array. For a plurality of the detected sounds, the audio system performs a direction of arrival (DoA) estimation. Based on parameters of the detected sound and/or the DoA estimation, the audio system may then generate or update one or more acoustic transfer functions unique to a user. The audio system may use the one or more acoustic transfer functions to generate audio content for the user.

26 Claims, 6 Drawing Sheets

(56) References Cited

U.S. PATENT DOCUMENTS

| | | | | |
|---|---|---|---|---|
| 2015/0341734 | A1* | 11/2015 | Sherman | H04R 1/406 381/92 |
| 2016/0165342 | A1* | 6/2016 | Benattar | H04R 1/406 381/92 |
| 2016/0260441 | A1* | 9/2016 | Muehlhausen | G06F 3/012 |

FOREIGN PATENT DOCUMENTS

| | | | |
|---|---|---|---|
| CN | 106416292 | A | 2/2017 |
| CN | 107430868 | A | 12/2017 |

* cited by examiner

500

AUDIO SYSTEM FOR DYNAMIC DETERMINATION OF PERSONALIZED ACOUSTIC TRANSFER FUNCTIONS

BACKGROUND

The present disclosure generally relates to stereophony and specifically to an audio system for dynamic determination of personalized acoustic transfer functions for a user.

A sound perceived at two ears can be different, depending on a direction and a location of a sound source with respect to each ear as well as on the surroundings of a room in which the sound is perceived. Humans can determine a location of the sound source by comparing the sound perceived at each ear. In a "surround sound" system, a plurality of speakers reproduce the directional aspects of sound using acoustic transfer functions. An acoustic transfer function represents the relationship between a sound at its source location and how the sound is detected, for example, by a microphone array or by a person. A single microphone array (or a person wearing a microphone array) may have several associated acoustic transfer functions for several different source locations in a local area surrounding the microphone array (or surrounding the person wearing the microphone array). In addition, acoustic transfer functions for the microphone array may differ based on the position and/or orientation of the microphone array in the local area. Furthermore, the acoustic sensors of a microphone array can be arranged in a large number of possible combinations, and, as such, the associated acoustic transfer functions are unique to the microphone array. As a result, determining acoustic transfer functions for each microphone array can require direct evaluation, which can be a lengthy and expensive process in terms of time and resources needed.

SUMMARY

Embodiments relate to an audio system for dynamic determination of an acoustic transfer function. An acoustic transfer function characterizes how a sound is received from a point in space. Specifically, an acoustic transfer function defines the relationship between parameters of a sound at its source location and the parameters at which the sound is detected by, for example, a microphone array or an ear of a user. The acoustic transfer function may be, e.g., an array transfer function (ATF) and/or a head-related transfer function (HRTF). In one embodiment, the audio system includes a microphone array that includes a plurality of acoustic sensors. Each acoustic sensor is configured to detect sounds within a local area surrounding the microphone array. At least some of the plurality of acoustic sensors are coupled to a near-eye display (NED). The audio system also includes a controller that is configured to estimate a direction of arrival (DoA) of a sound detected by the microphone array relative to a position of the NED within the local area. Based on the parameters of the detected sound, the controller generates or updates an acoustic transfer function associated with the audio system. Each acoustic transfer function is associated with a specific position of the NED within the local area, such that the controller generates or updates a new acoustic transfer function as the position of the NED changes within the local area. In some embodiments, the audio system uses the one or more acoustic transfer functions to generate audio content for a user wearing the NED.

In some embodiments, a method for dynamic determination of an acoustic transfer function is described. A microphone array monitors sounds in a local area surrounding the microphone array. The microphone array includes a plurality of acoustic sensors. At least some of the plurality of acoustic sensors are coupled to a near-eye display (NED). A direction of arrival (DoA) of a detected sound relative to a position of the NED within the local area is estimated. Based on the DoA estimation, an acoustic transfer function associated with the NED is updated. The acoustic transfer function may be, e.g., an array transfer function of the microphone array or an HRTF associated with the user. In some embodiments, a computer-readable medium may be configured to perform the steps of the method.

BRIEF DESCRIPTION OF THE DRAWINGS

Figure

Figure 1:
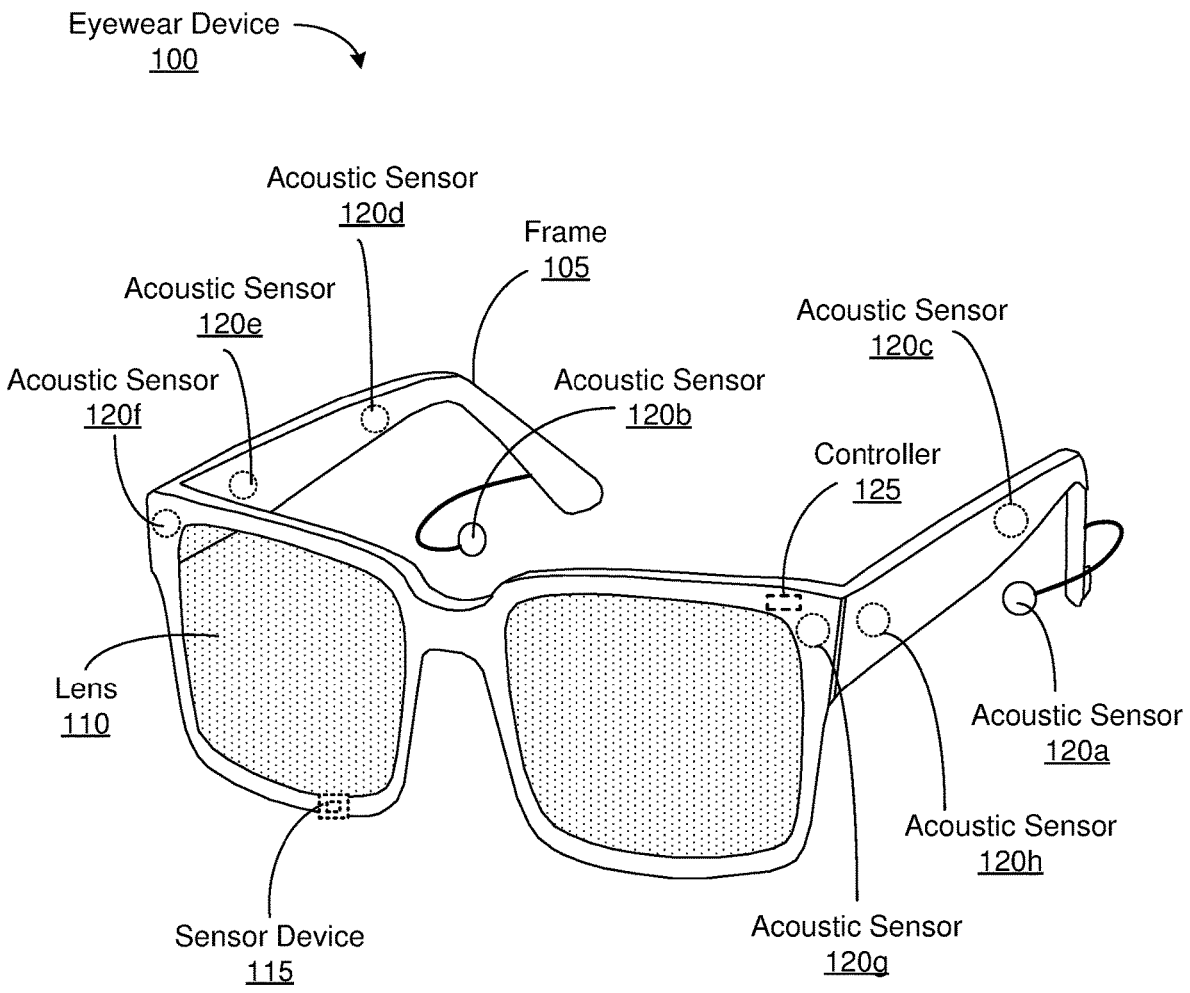
(FIG. 1 is an example illustrating an eyewear device including a microphone array, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Acoustic transfer functions are sometimes determined (e.g., via a speaker array) in a sound dampening chamber for many different source locations (e.g., typically more than a 100) relative to a person. The determined acoustic transfer functions may then be used to generate a "surround sound" experience for the person. However, the quality of the surround sound depends heavily on the number of different locations used to generate the acoustic transfer functions. Moreover, to reduce error, multiple acoustic transfer functions may be determined for each speaker location (i.e., each speaker is generating a plurality of discrete sounds). Accordingly, for high quality surround sound it may take a relatively long time (e.g., more than an hour) to determine the acoustic transfer functions as there are multiple acoustic transfer functions determined for many different speaker locations. Additionally, the infrastructure for measuring acoustic transfer functions sufficient for quality surround sound may be complex (e.g., sound dampening chamber, one or more speaker arrays, etc.). Accordingly, some approaches for obtaining acoustic transfer functions are inefficient in terms of hardware resources and/or time needed.

An audio system detects sound to generate one or more acoustic transfer functions for a user. In one embodiment, the audio system includes a microphone array that includes a plurality of acoustic sensors and a controller. Each acoustic sensor is configured to detect sounds within a local area surrounding the microphone array. At least some of the plurality of acoustic sensors are coupled to a near-eye display (NED) configured to be worn by the user. In some embodiments, some of the plurality of acoustic sensors are coupled to a neckband coupled to the NED. As the user moves throughout the local area surrounding the user, the microphone array detects uncontrolled and controlled sounds. Uncontrolled sounds are sounds that are not controlled by the audio system and happen in the local area (e.g., naturally occurring ambient noise). Controlled sounds are sounds that are controlled by the audio system.

The controller is configured to estimate a direction of arrival (DoA) of a sound detected by the microphone array relative to a position of the NED within the local area. In some embodiments, the controller populates an audio data set with information, which may include a detected sound and parameters associated with each detected sound. Example parameters may include a frequency, an amplitude, a duration, a DoA estimation, a source location, or some combination thereof. Based on the audio data set, the controller generates or updates an acoustic transfer function for a source location of a detected sound relative to the position of the NED. An acoustic transfer function characterizes how a sound is received from a point in space. Specifically, an acoustic transfer function defines the relationship between parameters of a sound at its source location and the parameters at which the sound is detected by, for example, a microphone array or an ear of a user. The acoustic transfer function may be, e.g., an array transfer function (ATF) and/or a head-related transfer function (HRTF). Each acoustic transfer function is associated with a particular source location and a specific position of the NED within the local area, such that the controller generates or updates a new acoustic transfer function as the position of the NED changes within the local area. In some embodiments, the audio system uses the one or more acoustic transfer functions to generate audio content (e.g., surround sound) for a user wearing the NED.

Embodiments of the present disclosure may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a head-mounted display (HIVID) connected to a host computer system, a standalone HIVID, a mobile device or computing system, or any other hardware platform capable of providing artificial reality content to one or more viewers.

Eyewear Device Configuration

FIG. 1 is an example illustrating an eyewear device 100 including an audio system, in accordance with one or more embodiments. The eyewear device 100 presents media to a user. In one embodiment, the eyewear device 100 may be a near-eye display (NED). Examples of media presented by the eyewear device 100 include one or more images, video, audio, or some combination thereof. The eyewear device 100 may include, among other components, a frame 105, a lens 110, a sensor device 115, and an audio system. The audio system may include, among other components, a microphone array of one or more acoustic sensors 120 and a controller 125. While FIG. 1 illustrates the components of the eyewear device 100 in example locations on the eyewear device 100, the components may be located elsewhere on the eyewear device 100, on a peripheral device paired with the eyewear device 100, or some combination thereof.

The eyewear device 100 may correct or enhance the vision of a user, protect the eye of a user, or provide images to a user. The eyewear device 100 may be eyeglasses which correct for defects in a user's eyesight. The eyewear device 100 may be sunglasses which protect a user's eye from the sun. The eyewear device 100 may be safety glasses which protect a user's eye from impact. The eyewear device 100 may be a night vision device or infrared goggles to enhance a user's vision at night. The eyewear device 100 may be a near-eye display that produces VR, AR, or MR content for the user. Alternatively, the eyewear device 100 may not include a lens 110 and may be a frame 105 with an audio system that provides audio (e.g., music, radio, podcasts) to a user.

The frame 105 includes a front part that holds the lens 110 and end pieces to attach to the user. The front part of the frame 105 bridges the top of a nose of the user. The end pieces (e.g., temples) are portions of the frame 105 that hold the eyewear device 100 in place on a user (e.g., each end piece extends over a corresponding ear of the user). The length of the end piece may be adjustable to fit different users. The end piece may also include a portion that curls behind the ear of the user (e.g., temple tip, ear piece).

The lens 110 provides or transmits light to a user wearing the eyewear device 100. The lens 110 may be prescription lens (e.g., single vision, bifocal and trifocal, or progressive) to help correct for defects in a user's eyesight. The prescription lens transmits ambient light to the user wearing the eyewear device 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 is discussed with regards to FIG. 6. The lens 110 is held by a front part of the frame 105 of the eyewear device 100.

In some embodiments, the eyewear device 100 may include a depth camera assembly (DCA) that captures data describing depth information for a local area surrounding the eyewear device 100. In one embodiment, the DCA may include a structured light projector, an imaging device, and a controller. The captured data may be images captured by the imaging device of structured light projected onto the local area by the structured light projector. In one embodiment, the DCA may include two or more cameras that are oriented to capture portions of the local area in stereo and a controller. The captured data may be images captured by the two or more cameras of the local area in stereo. The controller computes the depth information of the local area using the captured data. Based on the depth information, the controller determines absolute positional information of the eyewear device 100 within the local area. The DCA may be integrated with the eyewear device 100 or may be positioned within the local area external to the eyewear device 100. In the latter embodiment, the controller of the DCA may transmit the depth information to the controller 125 of the eyewear device 100.

The sensor device 115 generates one or more measurement signals in response to motion of the eyewear device 100. The sensor device 115 may be located on a portion of the frame 105 of the eyewear device 100. The sensor device 115 may include a position sensor, an inertial measurement unit (IMU), or both. Some embodiments of the eyewear device 100 may or may not include the sensor device 115 or may include more than one sensor device 115. In embodiments in which the sensor device 115 includes an IMU, the IMU generates fast calibration data based on measurement signals from the sensor device 115. Examples of sensor devices 115 include: one or more accelerometers, one or more gyroscopes, one or more magnetometers, another suitable type of sensor that detects motion, a type of sensor used for error correction of the IMU, or some combination thereof. The sensor device 115 may be located external to the IMU, internal to the IMU, or some combination thereof.

Based on the one or more measurement signals, the sensor device 115 estimates a current position of the eyewear device 100 relative to an initial position of the eyewear device 100. The estimated position may include a location of the eyewear device 100 and/or an orientation of the eyewear device 100 or the user's head wearing the eyewear device 100, or some combination thereof. The orientation may correspond to a position of each ear relative to the reference point. In some embodiments, the sensor device 115 uses the depth information and/or the absolute positional information from a DCA to estimate the current position of the eyewear device 100. The sensor device 115 may include multiple accelerometers to measure translational motion (forward/back, up/down, left/right) and multiple gyroscopes to measure rotational motion (e.g., pitch, yaw, roll). In some embodiments, an IMU rapidly samples the measurement signals and calculates the estimated position of the eyewear device 100 from the sampled data. For example, the IMU integrates the measurement signals received from the accelerometers over time to estimate a velocity vector and integrates the velocity vector over time to determine an estimated position of a reference point on the eyewear device 100. Alternatively, the IMU provides the sampled measurement signals to the controller 125, which determines the fast calibration data. The reference point is a point that may be used to describe the position of the eyewear device 100. While the reference point may generally be defined as a point in space, however, in practice the reference point is defined as a point within the eyewear device 100.

The audio system detects sound to generate one or more acoustic transfer functions for a user. An acoustic transfer function characterizes how a sound is received from a point in space. The acoustic transfer functions may be array transfer functions (ATFs), head-related transfer functions (HRTFs), other types of acoustic transfer functions, or some combination thereof. The one or more acoustic transfer functions may be associated with the eyewear device 100, the user wearing the eyewear device 100, or both. The audio system may then use the one or more acoustic transfer functions to generate audio content for the user. The audio system of the eyewear device 100 includes a microphone array and the controller 125.

The microphone array detects sounds within a local area surrounding the microphone array. The microphone array includes a plurality of acoustic sensors. The acoustic sensors are sensors that detect air pressure variations due to a sound wave. Each acoustic sensor is configured to detect sound and convert the detected sound into an electronic format (analog or digital). The acoustic sensors may be acoustic wave sensors, microphones, sound transducers, or similar sensors that are suitable for detecting sounds. For example, in FIG. 1, the microphone array includes eight acoustic sensors: acoustic sensors 120*a*, 120*b*, which may be designed to be placed inside a corresponding ear of the user, and acoustic sensors 120*c*, 120*d*, 120*e*, 120*f*, 120*g*, 120*h*, which are positioned at various locations on the frame 105. The acoustic sensors 120*a*-120*h* may be collectively referred to herein as "acoustic sensors 120." Additional detail regarding the audio system is discussed with regards to FIG. 4.

The microphone array detects sounds within the local area surrounding the microphone array. The local area is the environment that surrounds the eyewear device 100. For example, the local area may be a room that a user wearing the eyewear device 100 is inside, or the user wearing the eyewear device 100 may be outside and the local area is an outside area in which the microphone array is able to detect sounds. Detected sounds may be uncontrolled sounds or controlled sounds. Uncontrolled sounds are sounds that are not controlled by the audio system and happen in the local area. Examples of uncontrolled sounds may be naturally occurring ambient noise. In this configuration, the audio system may be able to calibrate the eyewear device 100 using the uncontrolled sounds that are detected by the audio system. Controlled sounds are sounds that are controlled by the audio system. Examples of controlled sounds may be one or more signals output by an external system, such as a speaker, a speaker assembly, a calibration system, or some combination thereof. While the eyewear device 100 may be calibrated using uncontrolled sounds, in some embodiments, the external system may be used to calibrate the eyewear device 100 during a calibration process. Each detected sound (uncontrolled and controlled) may be associated with a frequency, an amplitude, a duration, or some combination thereof.

The configuration of the acoustic sensors 120 of the microphone array may vary. While the eyewear device 100 is shown in FIG. 1 as having eight acoustic sensors 120, the number of acoustic sensors 120 may be increased or decreased. Increasing the number of acoustic sensors 120 may increase the amount of audio information collected and the sensitivity and/or accuracy of the audio information. Decreasing the number of acoustic sensors 120 may decrease the computing power required by the controller 125 to process the collected audio information. In addition, the position of each acoustic sensor 120 of the microphone array may vary. The position of an acoustic sensor 120 may include a defined position on the user, a defined coordinate on the frame 105, an orientation associated with each acoustic sensor, or some combination thereof. For example, the acoustic sensors 120*a*, 120*b* may be positioned on a different part of the user's ear, such as behind the pinna or within the auricle or fossa, or there may be additional acoustic sensors on or surrounding the ear in addition to the acoustic sensors 120 inside the ear canal. Having an acoustic sensor (e.g., acoustic sensors 120*a*, 120*b*) positioned next to an ear canal of a user enables the microphone array to collect information on how sounds arrive at the ear canal. The acoustic sensors 120 on the frame 105 may be positioned along the length of the temples, across the bridge, above or below the lenses 110, or some combination thereof. The acoustic sensors 120 may be oriented such that the microphone array is able to detect sounds in a wide range of directions surrounding the user wearing the eyewear device 100.

The controller 125 processes information from the microphone array that describes sounds detected by the microphone array. The information associated with each detected sound may include a frequency, an amplitude, and/or a duration of the detected sound. For each detected sound, the controller 125 performs a DoA estimation. The DoA estimation is an estimated direction from which the detected sound arrived at an acoustic sensor of the microphone array. If a sound is detected by at least two acoustic sensors of the microphone array, the controller 125 can use the known positional relationship of the acoustic sensors and the DoA estimation from each acoustic sensor to estimate a source location of the detected sound, for example, via triangulation. The accuracy of the source location estimation may increase as the number of acoustic sensors that detected the sound increases and/or as the distance between the acoustic sensors that detected the sound increases.

In some embodiments, the controller 125 populates an audio data set with information. The information may include a detected sound and parameters associated with each detected sound. Example parameters may include a frequency, an amplitude, a duration, a DoA estimation, a source location, or some combination thereof. Each audio data set may correspond to a different source location relative to the NED and include one or more sounds having that source location. This audio data set may be associated with one or more acoustic transfer functions for that source location. The one or more acoustic transfer functions may be stored in the data set. In alternate embodiments, each audio data set may correspond to several source locations relative to the NED and include one or more sounds for each source location. For example, source locations that are located relatively near to each other may be grouped together. The controller 125 may populate the audio data set with information as sounds are detected by the microphone array. The controller 125 may further populate the audio data set for each detected sound as a DoA estimation is performed or a source location is determined for each detected sound.

In some embodiments, the controller 125 selects the detected sounds for which it performs a DoA estimation. The controller 125 may select the detected sounds based on the parameters associated with each detected sound stored in the audio data set. The controller 125 may evaluate the stored parameters associated with each detected sound and determine if one or more stored parameters meet a corresponding parameter condition. For example, a parameter condition may be met if a parameter is above or below a threshold value or falls within a target range. If a parameter condition is met, the controller 125 performs a DoA estimation for the detected sound. For example, the controller 125 may perform a DoA estimation for detected sounds that have a frequency within a frequency range, an amplitude above a threshold amplitude, a duration below a threshold duration, other similar variations, or some combination thereof. Parameter conditions may be set by a user of the audio system, based on historical data, based on an analysis of the information in the audio data set (e.g., evaluating the collected information of the parameter and setting an average), or some combination thereof. The controller 125 may create an element in the audio set to store the DoA estimation and/or source location of the detected sound. In some embodiments, the controller 125 may update the elements in the audio set if data is already present.

In some embodiments, the controller 125 may receive position information of the eyewear device 100 from a system external to the eyewear device 100. The position information may include a location of the eyewear device 100, an orientation of the eyewear device 100 or the user's head wearing the eyewear device 100, or some combination thereof. The position information may be defined relative to a reference point. The orientation may correspond to a position of each ear relative to the reference point. Examples of systems include an imaging assembly, a console (e.g., as described in FIG. 6), a simultaneous localization and mapping (SLAM) system, a depth camera assembly, a structured light system, or other suitable systems. In some embodiments, the eyewear device 100 may include sensors that may be used for SLAM calculations, which may be carried out in whole or in part by the controller 125. The controller 125 may receive position information from the system continuously or at random or specified intervals.

Based on parameters of the detected sounds, the controller 125 generates one or more acoustic transfer functions associated with the audio system. The acoustic transfer functions may be array transfer functions (ATFs), head-related transfer functions (HRTFs), other types of acoustic transfer functions, or some combination thereof. An ATF characterizes how the microphone array receives a sound from a point in space. Specifically, the ATF defines the relationship between parameters of a sound at its source location and the parameters at which the microphone array detected the sound. Parameters associated with the sound may include frequency, amplitude, duration, a DoA estimation, etc. In some embodiments, at least some of the acoustic sensors of the microphone array are coupled to an NED that is worn by a user. The ATF for a particular source location relative to the microphone array may differ from user to user due to a person's anatomy (e.g., ear shape, shoulders, etc.) that affects the sound as it travels to the person's ears. Accordingly, the ATFs of the microphone array are personalized for each user wearing the NED.

The HRTF characterizes how an ear receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. For example, in FIG. 1, the controller 125 may generate two HRTFs for the user, one for each ear. An HRTF or a pair of HRTFs can be used to create audio content that includes sounds that seem to come from a specific point in space. Several HRTFs may be used to create surround sound audio content (e.g., for home entertainment systems, theater speaker systems, an immersive environment, etc.), where each HRTF or each pair of HRTFs corresponds to a different point in space such that audio content seems to come from several different points in space. In some embodiments, the controller 125 may update a pre-existing acoustic transfer function based on the DoA estimation of each detected sound. As the position of the eyewear device 100 changes within the local area, the controller 125 may generate a new acoustic transfer function or update a pre-existing acoustic transfer function accordingly.

Figure 2:
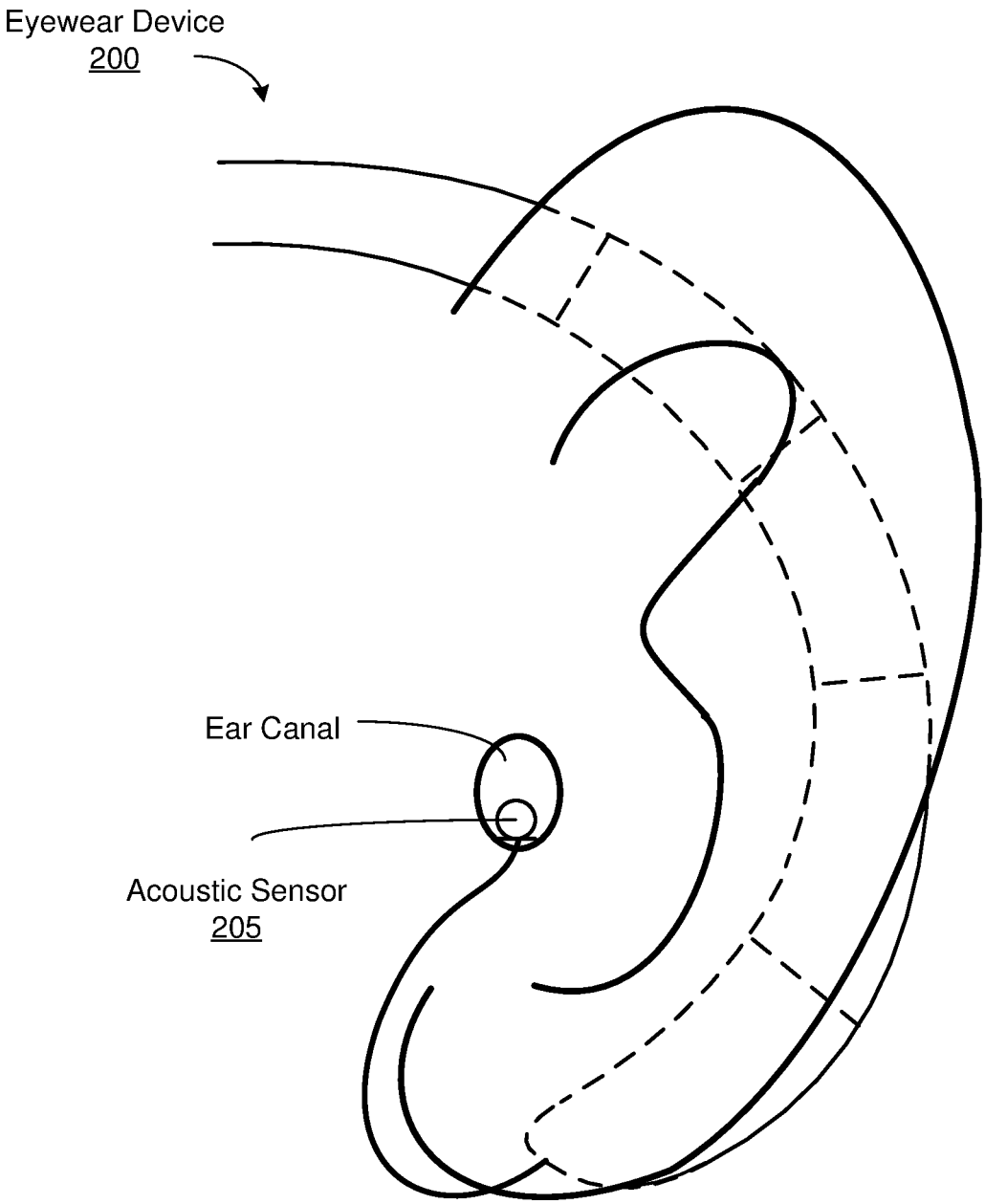
FIG. 2 is an example illustrating a portion of the eyewear device including an acoustic sensor that is a microphone on an ear of a user, in accordance with one or more embodiments.

FIG. 2 is an example illustrating a portion of an eyewear device 200 including the acoustic sensor 120*a* that is a microphone on an ear of a user, in accordance with one or more embodiments. The eyewear device 200 may be an embodiment of the eyewear device 100. The acoustic sensor 205 may be an embodiment of the acoustic sensor 120. As illustrated in FIG. 2, a portion of the eyewear device 200 is positioned behind the pinna to secure the eyewear device 200 to the user. The acoustic sensor 205 is positioned at an entrance of the ear of the user to detect pressure waves produced by sounds within the local area surrounding the user. Positioning an acoustic sensor 205 next to (or within) an ear canal of a user enables the acoustic sensor 205 to collect information on how sounds arrive at the ear canal such that a unique HRTF may be generated for each ear of the user.

Figure 3:
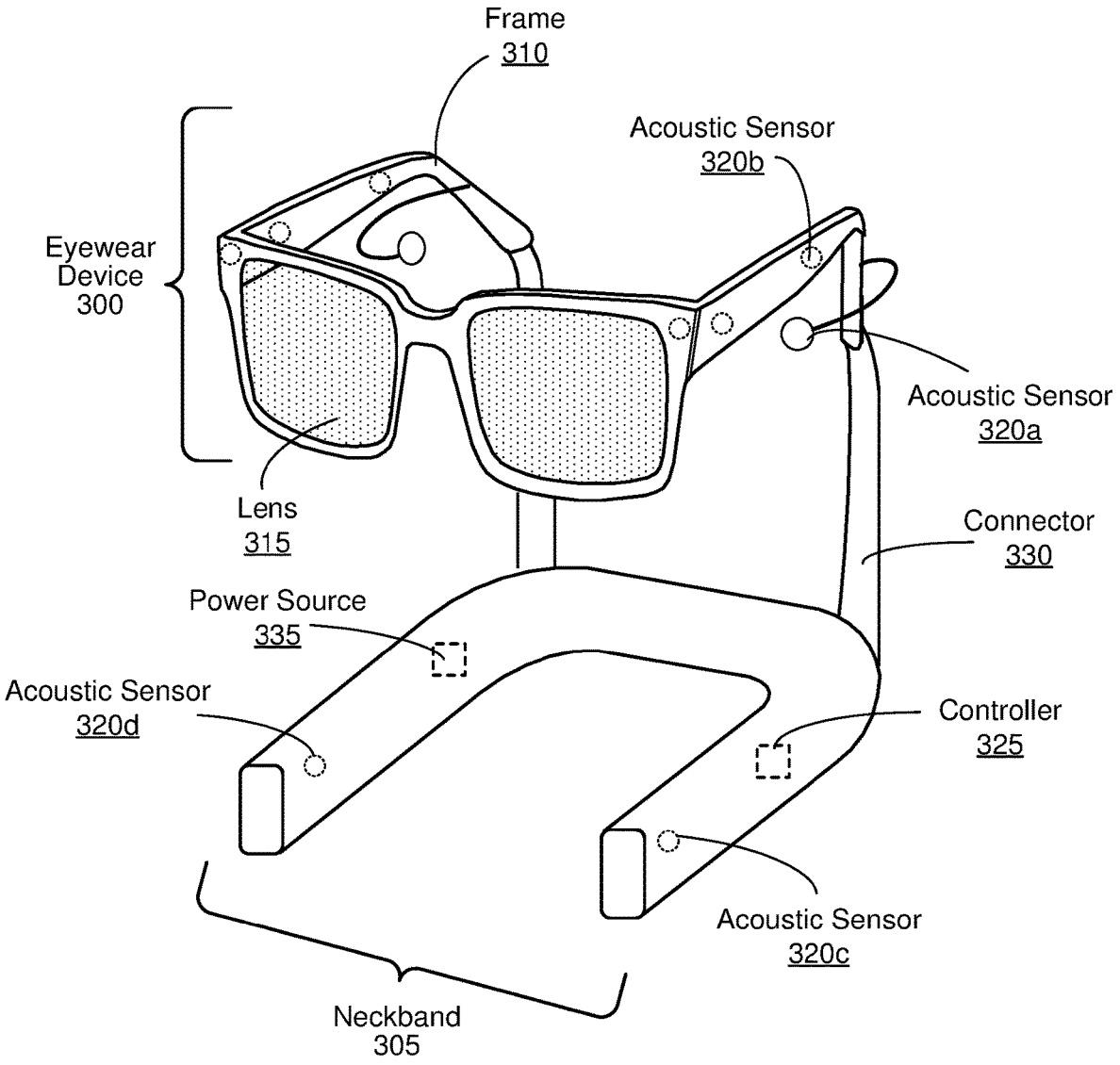
FIG. 3 is an example illustrating an eyewear device including a neckband, in accordance with one or more embodiments.

FIG. 3 is an example illustrating an eyewear device 300 including a neckband 305, in accordance with one or more embodiments. In FIG. 3, the eyewear device 300 includes a frame 310, lenses 315, and an audio system. The eyewear device 300 may be an embodiment of the eyewear device 100. The audio system may be an embodiment of the audio system described with regards to FIG. 1. The audio system includes a microphone array, which includes several acoustic sensors, such as acoustic sensor 320*a*, which may be designed to be placed inside a corresponding ear of the user, and acoustic sensor 320*b*, which may be positioned along the frame 310. The audio system additionally includes a controller 325. The controller 325 may be an embodiment of the controller 125. The eyewear device 300 is coupled to the neckband 305 via a connector 330. While FIG. 3 illustrates the components of the eyewear device 300 and the neckband 305 in example locations on the eyewear device 300 and the neckband 305, the components may be located elsewhere and/or distributed differently on the eyewear device 300 and the neckband 305, on one or more additional peripheral devices paired with the eyewear device 300 and/or the neckband 305, or some combination thereof.

One way to allow eyewear devices to achieve the form factor of a pair of glasses, while still providing sufficient battery and computation power and allowing for expanded capabilities is to use a paired neckband. The power, computation and additional features may then be moved from the eyewear device to the neckband, thus reducing the weight, heat profile, and form factor of the eyewear device overall, while still retaining full functionality (e.g., AR, VR, and/or MR). The neckband allows components that would otherwise be included on the eyewear device to be heavier, since users may tolerate a heavier weight load on their shoulders than they would otherwise tolerate on their heads, due to a combination of soft-tissue and gravity loading limits. The neckband also has a larger surface area over which to diffuse and disperse generated heat to the ambient environment. Thus the neckband allows for greater battery and computation capacity than might otherwise have been possible simply on a stand-alone eyewear device. Since a neckband may be less invasive to a user than the eyewear device, the user may tolerate wearing the neckband for greater lengths of time than the eyewear device, allowing the artificial reality environment to be incorporated more fully into a user's day to day activities.

In the embodiment of FIG. 3, the neckband 305 is formed in a "U" shape that conforms to the user's neck. The neckband 305 is worn around a user's neck, while the eyewear device 300 is worn on the user's head. A first arm and a second arm of the neckband 305 may each rest on the top of a user's shoulders close to his or her neck such that the weight of the first arm and second arm are carried by the user's neck base and shoulders. The connector 330 is long enough to allow the eyewear device 300 to be worn on a user's head while the neckband 305 rests around the user's neck. The connector 330 may be adjustable, allowing each user to customize the length of connector 330. The neckband 305 is communicatively coupled with the eyewear device 300. In some embodiments, the neckband 305 may be communicatively coupled to the eyewear device 300 and/or other devices. The other devices in the system may provide certain functions (e.g., tracking, localizing, depth mapping, processing, storage, etc.) to the eyewear device 300. In the embodiment of FIG. 3, the neckband 305 includes two acoustic sensors 320*c*, 320*d* of the microphone array, the controller 325, and a power source 335. The acoustic sensors 320 may be embodiments of the acoustic sensors 120.

The acoustic sensors 320*c*, 320*d* of the microphone array are positioned on the neckband 305. The acoustic sensors 320*c*, 320*d* may be embodiments of the acoustic sensor 120. The acoustic sensors 320*c*, 320*d* are configured to detect sound and convert the detected sound into an electronic format (analog or digital). The acoustic sensors may be acoustic wave sensors, microphones, sound transducers, or similar sensors that are suitable for detecting sounds. In the embodiment of FIG. 3, the acoustic sensors 320*c*, 320*d* are positioned on the neckband 305, thereby increasing the distance between the acoustic sensors 320*c*, 320*d* and the other acoustic sensors 320 positioned on the eyewear device 300. Increasing the distance between acoustic sensors 320 of the microphone array improve the accuracy of the microphone array. For example, if a sound is detected by acoustic sensors 320*b* and 320*c*, the distance between acoustic sensors 320*b* and 320*c* is greater than, e.g., the distance between acoustic sensors 320*a* and 320*b*, such that a determined source location of the detected sound may be more accurate than if the sound had been detected by acoustic sensors 320*a* and 320*b*.

The controller 325 processes information generated by the sensors on the eyewear device 300 and/or the neckband 305. The controller 325 may be an embodiment of the controller 125 and may perform some or all of the functions of the controller 125 described with regards to FIG. 1. The sensors on the eyewear device 300 may include the acoustic sensors 320, position sensors, an inertial measurement unit (IMU), other suitable sensors, or some combination thereof. For example, the controller 325 processes information from the microphone array that describes sounds detected by the microphone array. For each detected sound, the controller 325 may perform a DoA estimation to estimate a direction from which the detected sound arrived at the microphone array. As the microphone array detects sounds, the controller 325 may populate an audio data set with the information. In embodiments in which the eyewear device 300 includes an inertial measurement unit, the controller 325 may compute all inertial and spatial calculations from the IMU located on the eyewear device 300. The connector 330 may convey information between the eyewear device 300 and the neckband 305 and between the eyewear device 300 and the controller 325. The information may be in the form of optical data, electrical data, or any other transmittable data form. Moving the processing of information generated by the eyewear device 300 to the neckband 305 reduces the weight and heat generation of the eyewear device 300 making it more comfortable to the user.

The power source 335 provides power to the eyewear device 300 and the neckband 305. The power source 335 may be lithium ion batteries, lithium-polymer battery, primary lithium batteries, alkaline batteries, or any other form of power storage. Locating the power source 335 on the neckband 305 may distribute the weight and heat generated by the power source 335 from the eyewear device 300 to the neckband 305, which may better diffuse and disperse heat, and also utilizes the carrying capacity of a user's neck base and shoulders. Locating the power source 335, controller 325 and any number of other sensors on the neckband device 305 may also better regulate the heat exposure of each of these elements, as positioning them next to a user's neck may protect them from solar and environmental heat sources.

Audio System Overview

Figure 4:
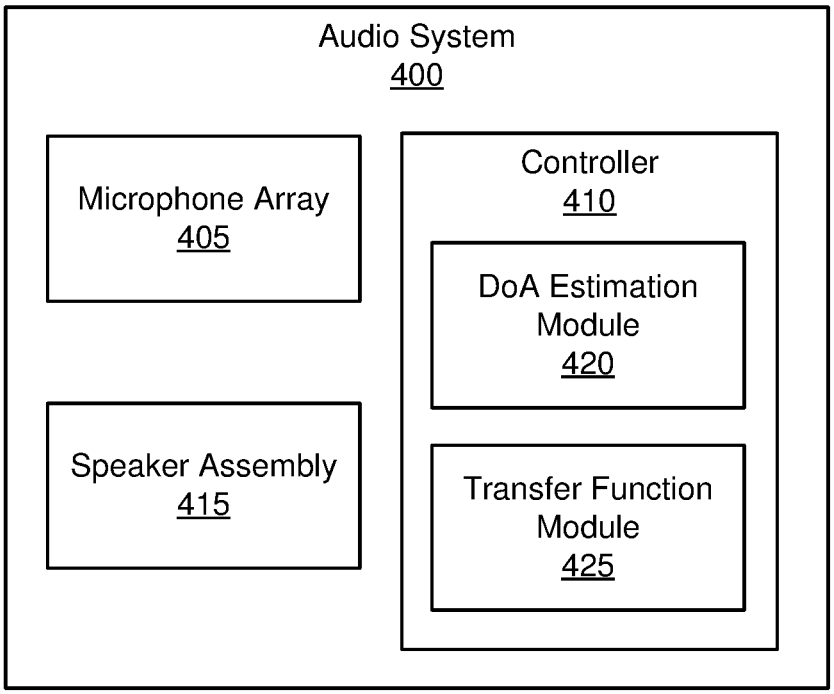
FIG. 4 is a block diagram of an audio system, in accordance with one or more embodiments.

FIG. 4 is a block diagram of an audio system 400, in accordance with one or more embodiments. The audio system in FIGS. 1 and 3 may be embodiments of the audio system 400. The audio system 400 detects sound to generate one or more acoustic transfer functions for a user. The audio system 400 may then use the one or more acoustic transfer functions to generate audio content for the user. In the embodiment of FIG. 4, the audio system 400 includes a microphone array 405, a controller 410, and a speaker assembly 415. Some embodiments of the audio system 400 have different components than those described here. Similarly, in some cases, functions can be distributed among the components in a different manner than is described here.

The microphone array 405 detects sounds within a local area surrounding the microphone array. The microphone array 405 may include a plurality of acoustic sensors that each detect air pressure variations of a sound wave and convert the detected sounds into an electronic format (analog or digital). The plurality of acoustic sensors may be positioned on an eyewear device (e.g., eyewear device 100), on a user (e.g., in an ear canal of the user), on a neckband, or some combination thereof. As described with regards to FIG. 1, detected sounds may be uncontrolled sounds or controlled sounds. Each detected sound may be associated with audio information such as a frequency, an amplitude, a duration, or some combination thereof. Each acoustic sensor of the microphone array 405 may be active (powered on) or inactive (powered off). The acoustic sensors are activated or deactivated in accordance with instructions from the controller 410. In some embodiments, all of the acoustic sensors in the microphone array 405 may be active to detect sounds, or a subset of the plurality of acoustic sensors may be active. An active subset includes at least two acoustic sensors of the plurality of acoustic sensors. An active subset may include, e.g., every other acoustic sensor, a pre-programmed initial subset, a random subset, or some combination thereof.

The controller 410 processes information from the microphone array 405. In addition, the controller 410 controls other modules and devices of the audio system 400. The information associated with each detected sound may include a frequency, an amplitude, and/or a duration of the detected sound. In the embodiment of FIG. 4, the controller 410 includes the DoA estimation module 420, and the transfer function module 425.

The DoA estimation module 420 performs a DoA estimation for detected sound. DoA estimation is an estimated direction from which a detected sound arrived at an acoustic sensor of the microphone array 405. If a sound is detected by at least two acoustic sensors of the microphone array, the controller 125 can use the positional relationship of the acoustic sensors and the sound detected from each acoustic sensor to estimate a source location of the detected sound, for example, via triangulation. The DoA estimation of each detected sound may be represented as a vector between an estimated source location of the detected sound and the position of the microphone array 405 within the local area. The estimated source location may be a relative position of the source location in the local area relative to a position of the microphone array 405. The position of the microphone array 405 may be determined by one or more sensors on an eyewear device and/or neckband having the microphone array 405. In some embodiments, the controller 410 may determine an absolute position of the source location if an absolute position of the microphone array 405 is known in the local area. The position of the microphone array 405 may be received from an external system (e.g., an imaging assembly, an AR or VR console, a SLAM system, a depth camera assembly, a structured light system etc.). The external system may create a virtual model of the local area, in which the local area and the position of the microphone array 405 are mapped. The received position information may include a location and/or an orientation of the microphone array in the mapped local area. The controller 410 may update the mapping of the local area with determined source locations of detected sounds. The controller 125 may receive position information from the external system continuously or at random or specified intervals. In some embodiments, the controller 410 selects the detected sounds for which it performs a DoA estimation.

The DoA estimation module 420 selects the detected sounds for which it performs a DoA estimation. As described with regards to FIG. 1, the DoA estimation module 420 populates an audio data set with information. The information may include a detected sound and parameters associated with each detected sound. Example parameters may include a frequency, an amplitude, a duration, a DoA estimation, a source location, or some combination thereof. Each audio data set may correspond to a different source location relative to the microphone array 405 and include one or more sounds having that source location. The DoA estimation module 420 may populate the audio data set as sounds are detected by the microphone array 405. The DoA estimation module 420 may evaluate the stored parameters associated with each detected sound and determine if one or more stored parameters meet a corresponding parameter condition. For example, a parameter condition may be met if a parameter is above or below a threshold value or falls within a target range. If a parameter condition is met, the DoA estimation module 420 performs a DoA estimation for the detected sound. For example, the DoA estimation module 420 may perform a DoA estimation for detected sounds that have a frequency within a frequency range, an amplitude above a threshold amplitude, a duration below a threshold duration range, other similar variations or some combination thereof. Parameter conditions may be set by a user of the audio system 400, based on historical data, based on an analysis of the information in the audio data set (e.g., evaluating the collected information for a parameter and setting an average), or some combination thereof. The DoA estimation module 420 may further populate or update the audio data set as it performs DoA estimations for detected sounds.

The transfer function module 425 generates one or more acoustic transfer functions associated with the source locations of sounds detected by the microphone array 405. Generally, a transfer function is a mathematical function giving a corresponding output value for each possible input value. In the embodiment of FIG. 4, an acoustic transfer function represents the relationship between a sound at its source location and how the sound is detected, for example, by a microphone array or by a person. Each acoustic transfer function may be associated with a position (i.e., location and/or orientation) of the microphone array or person and may be unique to that position. For example, as the location and/or orientation of the microphone array or head of the person changes, sounds may be detected differently in terms of frequency, amplitude, etc. In the embodiment of FIG. 4, the transfer function module 425 uses the information in the audio data set to generate the one or more acoustic transfer functions. The information may include a detected sound and parameters associated with each detected sound. Example parameters may include a frequency, an amplitude, a duration, a DoA estimation, a source location, or some combination thereof. The DoA estimations from the DoA estimation module 420 may improve the accuracy of the acoustic transfer functions. The acoustic transfer functions may be used for various purposes discussed in greater detail below. In some embodiments, the transfer function module 425 may update one or more pre-existing acoustic transfer functions based on the DoA estimations of the detected sounds. As the position (i.e., location and/or orientation) of the microphone array 405 changes within the local area, the controller 410 may generate a new acoustic transfer function or update a pre-existing acoustic transfer function accordingly associated with each position.

In one embodiment, the transfer function module 425 generates an array transfer function (ATF). The ATF characterizes how the microphone array 405 receives a sound from a point in space. Specifically, the ATF defines the relationship between parameters of a sound at its source location and the parameters at which the microphone array 405 detected the sound. Parameters associated with the sound may include frequency, amplitude, duration, etc. The transfer function module 425 may generate one or more ATFs for a particular source location of a detected sound, a position of the microphone array 405 in the local area, or some combination thereof. Factors that may affect how the sound is received by the microphone array 405 may include the arrangement and/or orientation of the acoustic sensors in the microphone array 405, any objects in between the sound source and the microphone array 405, an anatomy of a user wearing the eyewear device with the microphone array 405, or other objects in the local area. For example, if a user is wearing an eyewear device that includes the microphone array 405, the anatomy of the person (e.g., ear shape, shoulders, etc.) may affect the sound waves as it travels to the microphone array 405. In another example, if the user is wearing an eyewear device that includes the microphone array 405 and the local area surrounding the microphone array 405 is an outside environment including buildings, trees, bushes, a body of water, etc., those objects may dampen or amplify the amplitude of sounds in the local area. Generating and/or updating an ATF improves the accuracy of the audio information captured by the microphone array 405.

In one embodiment, the transfer function module 425 generates one or more HRTFs. An HRTF characterizes how an ear of a person receives a sound from a point in space. The HRTF for a particular source location relative to a person is unique to each ear of the person (and is unique to the person) due to the person's anatomy (e.g., ear shape, shoulders, etc.) that affects the sound as it travels to the person's ears. The transfer function module 425 may generate a plurality of HRTFs for a single person, where each HRTF may be associated with a different source location, a different position of the person wearing the microphone array 405, or some combination thereof. In addition, for each source location and/or position of the person, the transfer function module 425 may generate two HRTFs, one for each ear of the person. As an example, the transfer generation module 425 may generate two HRTFs for a user at a particular location and orientation of the user's head in the local area relative to a single source location. If the user turns his or her head in a different direction, the transfer generation module 425 may generate two new HRTFs for the user at the particular location and the new orientation, or the transfer generation module 425 may update the two pre-existing HRTFs. Accordingly, the transfer function module 425 generates several HRTFs for different source locations, different positions of the microphone array 405 in a local area, or some combination thereof.

In some embodiments, the transfer function module 425 may use the plurality of HRTFs and/or ATFs for a user to generate audio content for the user. The transfer function module 425 may generate an audio characterization configuration that can be used by the speaker assembly 415 for generating sounds (e.g., stereo sounds or surround sounds). The audio characterization configuration is a function, which the audio system 400 may use to synthesize a binaural sound that seems to come from a particular point in space. Accordingly, an audio characterization configuration specific to the user allows the audio system 400 to provide sounds and/or surround sound to the user. The audio system 400 may use the speaker assembly 415 to provide the sounds. In some embodiments, the audio system 400 may use the microphone array 405 in conjunction with or instead of the speaker assembly 415. In one embodiment, the plurality of ATFs, plurality of HRTFs, and/or the audio characterization configuration are stored on the controller 410.

The speaker assembly 415 is configured to transmit sound to a user. The speaker assembly 415 may operate according to commands from the controller 410 and/or based on an audio characterization configuration from the controller 410. Based on the audio characterization configuration, the speaker assembly 415 may produce binaural sounds that seem to come from a particular point in space. The speaker assembly 415 may provide a sequence of sounds or surround sound to the user. In some embodiments, the speaker assembly 415 and the microphone array 415 may be used together to provide sides to the user. The speaker assembly 415 may be coupled to an NED to which the microphone array 405 is coupled. In alternate embodiments, the speaker assembly 415 may be a plurality of speakers surrounding a user wearing the microphone array 405 (e.g., coupled to an NED). In one embodiment, the speaker assembly 415 transmits test sounds during a calibration process of the microphone array 405. The controller 410 may instruct the speaker assembly 415 to produce test sounds and then may analyze the test sounds received by the microphone array 405 to generate acoustic transfer functions for the eyewear device 100. Multiple test sounds with varying frequencies, amplitudes, durations, or sequences can be produced by the speaker assembly 415.

Head-Related Transfer Function (HRTF) Personalization

Figure 5:
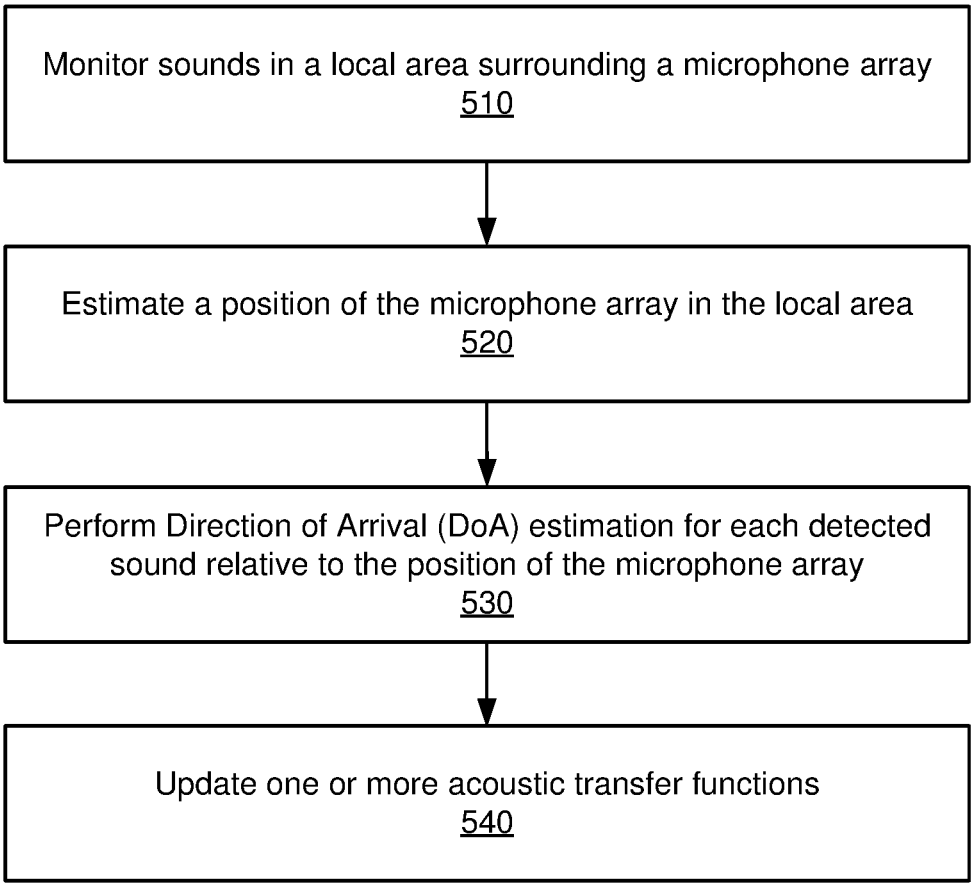
FIG. 5 is a flowchart illustrating a process of generating and updating a head-related transfer function of an eyewear device including an audio system, in accordance with one or more embodiments.

FIG. 5 is a flowchart illustrating a process 500 of generating and updating a head-related transfer function of an eyewear device (e.g., eyewear device 100) including an audio system (e.g., audio system 400), in accordance with one or more embodiments. In one embodiment, the process of FIG. 5 is performed by components of the audio system. Other entities may perform some or all of the steps of the process in other embodiments (e.g., a console). Likewise, embodiments may include different and/or additional steps, or perform the steps in different orders.

The audio system monitors 510 sounds in a local area surrounding a microphone array on the eyewear device. The microphone array may detect sounds such as uncontrolled sounds and controlled sounds that occur in the local area. Each detected sound may be associated with a frequency, an amplitude, a duration, or some combination thereof. In some embodiments, the audio system stores the information associated with each detected sound in an audio data set.

In some embodiments, the audio system optionally estimates 520 a position of the microphone array in the local area. The estimated position may include a location of the microphone array and/or an orientation of the eyewear device or a user's head wearing the eyewear device, or some combination thereof. In one embodiment, the audio system may include one or more sensors that generate one or more measurement signals in response to motion of the microphone array. The audio system may estimate 510 a current position of the microphone array relative to an initial position of the microphone array. In another embodiment, the audio system may receive position information of the eyewear device from an external system (e.g., an imaging assembly, an AR or VR console, a SLAM system, a depth camera assembly, a structured light system, etc.).

The audio system performs 530 a Direction of Arrival (DoA) estimation for each detected sound relative to the position of the microphone array. The DoA estimation is an estimated direction from which the detected sound arrived at an acoustic sensor of the microphone array. The DoA estimation may be represented as a vector between an estimated source location of the detected sound and the position of the eyewear device within the local area. In some embodiments, the audio system may perform 530 a DoA estimation for detected sounds associated with a parameter that meets a parameter condition. For example, a parameter condition may be met if a parameter is above or below a threshold value or falls within a target range.

The audio system updates 540 one or more acoustic transfer functions. The acoustic transfer function may be an array transfer function (ATF) or a head-related transfer function (HRTF). An acoustic transfer function represents the relationship between a sound at its source location and how the sound is detected. Accordingly, each acoustic transfer function is associated with a different source location of a detected sound, a different position of a microphone array, or some combination thereof. As a result, the audio system may update 540 a plurality of acoustic transfer functions for a particular source location and/or position of the microphone array in the local area. In some embodiments, the eyewear device may update 540 two HRTFs, one for each ear of a user, for a particular position of the microphone array in the local area. In some embodiments, the audio system generates one or more acoustic transfer functions that are each associated with a different source location of a detected sound, a different position of a microphone array, or some combination thereof.

If the position of the microphone array changes within the local area, the audio system may generate one or more new acoustic transfer functions or update 540 one or more pre-existing acoustic transfer functions accordingly. The process 500 may be continuously repeated as a user wearing the microphone array (e.g., coupled to an NED) moves through the local area, or the process 500 may be initiated upon detecting sounds via the microphone array.

Example System Environment

Figure 6:
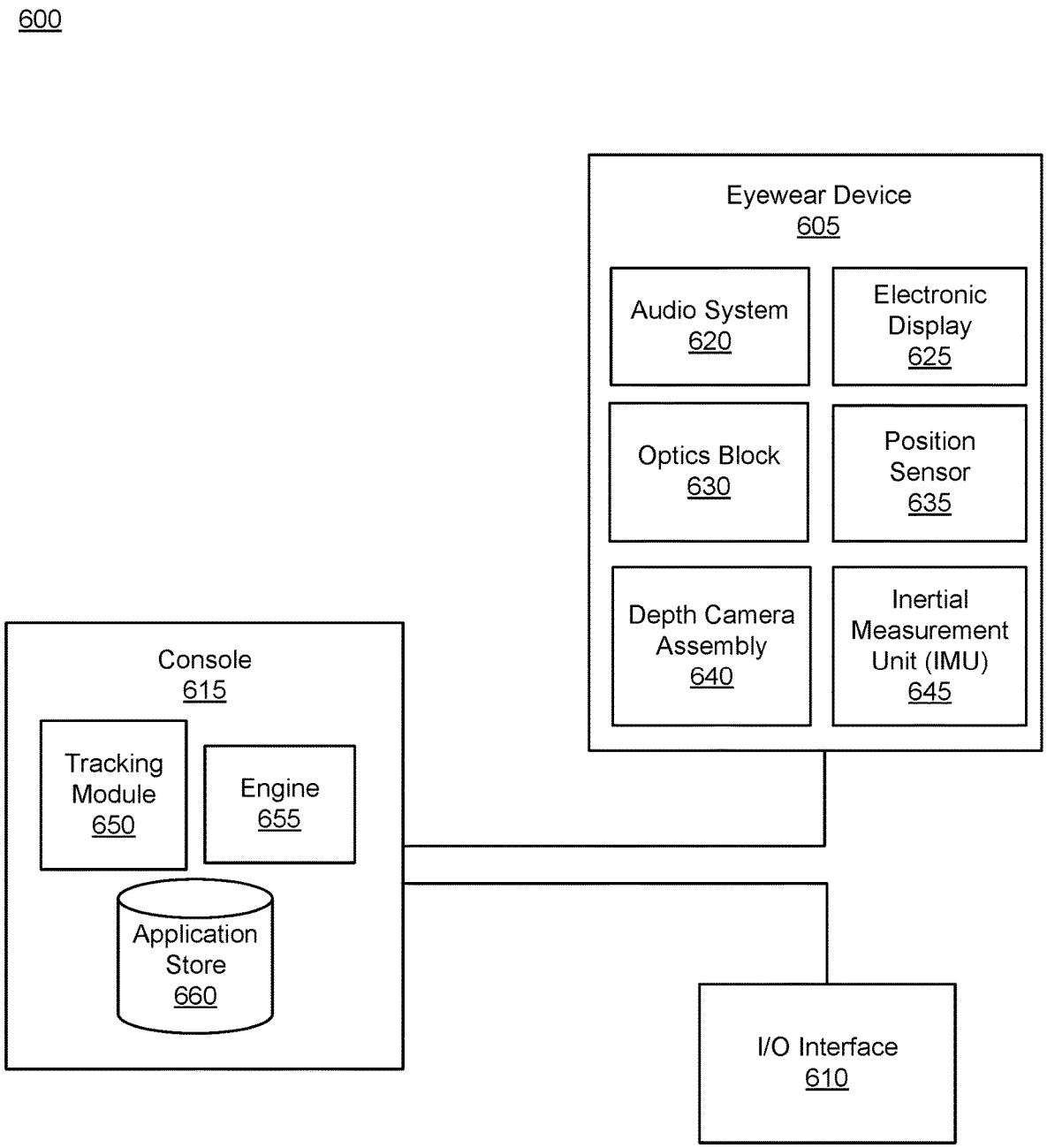
FIG. 6 is a system environment of an eyewear device including an audio system, in accordance with one or more embodiments.

FIG. 6 is a system environment 600 of an eyewear device 605 including an audio system, in accordance with one or more embodiments. The system 600 may operate in an artificial reality environment. The system 600 shown in FIG. 6 includes an eyewear device 605 and an input/output (I/O) interface 610 that is coupled to a console 615. The eyewear device 605 may be an embodiment of the eyewear device 100. While FIG. 6 shows an example system 600 including one eyewear device 605 and one I/O interface 610, in other embodiments any number of these components may be included in the system 600. For example, there may be multiple eyewear devices 605 each having an associated I/O interface 610 with each eyewear device 605 and I/O interface 610 communicating with the console 615. In alternative configurations, different and/or additional components may be included in the system 600. Additionally, functionality described in conjunction with one or more of the components shown in FIG. 6 may be distributed among the components in a different manner than described in conjunction with FIG. 6 in some embodiments. For example, some or all of the functionality of the console 615 is provided by the eyewear device 605.

In some embodiments, the eyewear device 605 may correct or enhance the vision of a user, protect the eye of a user, or provide images to a user. The eyewear device 605 may be eyeglasses which correct for defects in a user's eyesight. The eyewear device 605 may be sunglasses which protect a user's eye from the sun. The eyewear device 605 may be safety glasses which protect a user's eye from impact. The eyewear device 605 may be a night vision device or infrared goggles to enhance a user's vision at night. Alternatively, the eyewear device 605 may not include lenses and may be just a frame with an audio system 620 that provides audio (e.g., music, radio, podcasts) to a user.

In some embodiments, the eyewear device 605 may be a head-mounted display that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio system 620 that receives audio information from the eyewear device 605, the console 615, or both, and presents audio data based on the audio information. In some embodiments, the eyewear device 605 presents virtual content to the user that is based in part on a real environment surrounding the user. For example, virtual content may be presented to a user of the eyewear device. The user physically may be in a room, and virtual walls and a virtual floor of the room are rendered as part of the virtual content. In the embodiment of FIG. 6, the eyewear device 605 includes an audio system 620, an electronic display 625, an optics block 630, a position sensor 635, a depth camera assembly (DCA) 640, and an inertial measurement (IMU) unit 645. Some embodiments of the eyewear device 605 have different components than those described in conjunction with FIG. 6. Additionally, the functionality provided by various components described in conjunction with FIG. 6 may be distributed differently among the components of the eyewear device 605 in other embodiments or be captured in separate assemblies remote from the eyewear device 605.

The audio system 620 detects sound to generate one or more acoustic transfer functions for a user. The audio system 620 may then use the one or more acoustic transfer functions to generate audio content for the user. The audio system 620 may be an embodiment of the audio system 400. As described with regards to FIG. 4, the audio system 620 may include a microphone array, a controller, and a speaker assembly, among other components. The microphone array detects sounds within a local area surrounding the microphone array. The microphone array may include a plurality of acoustic sensors that each detect air pressure variations of a sound wave and convert the detected sounds into an electronic format (analog or digital). The plurality of acoustic sensors may be positioned on an eyewear device (e.g., eyewear device 100), on a user (e.g., in an ear canal of the user), on a neckband, or some combination thereof. Detected sounds may be uncontrolled sounds or controlled sounds. The controller performs a DoA estimation for the sounds detected by the microphone array. Based in part on the DoA estimations of the detected sounds and parameters associated with the detected sounds, the controller generates one or more acoustic transfer functions associated with the source locations of the detected sounds. The acoustic transfer functions may be ATFs, HRTFs, other types of acoustic transfer functions, or some combination thereof. The controller may generate instructions for the speaker assembly to emit audio content that seems to come from several different points in space.

The electronic display 625 displays 2D or 3D images to the user in accordance with data received from the console 615. In various embodiments, the electronic display 625 comprises a single electronic display or multiple electronic displays (e.g., a display for each eye of a user). Examples of the electronic display 625 include: a liquid crystal display (LCD), an organic light emitting diode (OLED) display, an active-matrix organic light-emitting diode display (AMOLED), some other display, or some combination thereof.

The optics block 630 magnifies image light received from the electronic display 625, corrects optical errors associated with the image light, and presents the corrected image light to a user of the eyewear device 605. The electronic display 625 and the optics block 630 may be an embodiment of the lens 110. In various embodiments, the optics block 630 includes one or more optical elements. Example optical elements included in the optics block 630 include: an aperture, a Fresnel lens, a convex lens, a concave lens, a filter, a reflecting surface, or any other suitable optical element that affects image light. Moreover, the optics block 630 may include combinations of different optical elements. In some embodiments, one or more of the optical elements in the optics block 630 may have one or more coatings, such as partially reflective or anti-reflective coatings.

Magnification and focusing of the image light by the optics block 630 allows the electronic display 625 to be physically smaller, weigh less, and consume less power than larger displays. Additionally, magnification may increase the field of view of the content presented by the electronic display 625. For example, the field of view of the displayed content is such that the displayed content is presented using almost all (e.g., approximately 110 degrees diagonal), and in some cases all, of the user's field of view. Additionally in some embodiments, the amount of magnification may be adjusted by adding or removing optical elements.

In some embodiments, the optics block 630 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 625 for display is predistorted, and the optics block 630 corrects the distortion when it receives image light from the electronic display 625 generated based on the content.

The DCA 640 captures data describing depth information for a local area surrounding the eyewear device 605. In one embodiment, the DCA 640 may include a structured light projector, an imaging device, and a controller. The captured data may be images captured by the imaging device of structured light projected onto the local area by the structured light projector. In one embodiment, the DCA 640 may include two or more cameras that are oriented to capture portions of the local area in stereo and a controller. The captured data may be images captured by the two or more cameras of the local area in stereo. The controller computes the depth information of the local area using the captured data. Based on the depth information, the controller determines absolute positional information of the eyewear device 605 within the local area. The DCA 640 may be integrated with the eyewear device 605 or may be positioned within the local area external to the eyewear device 605. In the latter embodiment, the controller of the DCA 640 may transmit the depth information to a controller of the audio system 620.

The IMU 645 is an electronic device that generates data indicating a position of the eyewear device 605 based on measurement signals received from one or more position sensors 635. The one or more position sensors 635 may be an embodiment of the sensor device 115. A position sensor 635 generates one or more measurement signals in response to motion of the eyewear device 605. Examples of position sensors 635 include: one or more accelerometers, one or more gyroscopes, one or more magnetometers, another suitable type of sensor that detects motion, a type of sensor used for error correction of the IMU 645, or some combination thereof. The position sensors 635 may be located external to the IMU 645, internal to the IMU 645, or some combination thereof.

Based on the one or more measurement signals from one or more position sensors 635, the IMU 645 generates data indicating an estimated current position of the eyewear device 605 relative to an initial position of the eyewear device 605. For example, the position sensors 635 include multiple accelerometers to measure translational motion (forward/back, up/down, left/right) and multiple gyroscopes to measure rotational motion (e.g., pitch, yaw, and roll). In some embodiments, the IMU 645 rapidly samples the measurement signals and calculates the estimated current position of the eyewear device 605 from the sampled data. For example, the IMU 645 integrates the measurement signals received from the accelerometers over time to estimate a velocity vector and integrates the velocity vector over time to determine an estimated current position of a reference point on the eyewear device 605. Alternatively, the IMU 645 provides the sampled measurement signals to the console 615, which interprets the data to reduce error. The reference point is a point that may be used to describe the position of the eyewear device 605. The reference point may generally be defined as a point in space or a position related to the eyewear device's 605 orientation and position.

The IMU 645 receives one or more parameters from the console 615. As further discussed below, the one or more parameters are used to maintain tracking of the eyewear device 605. Based on a received parameter, the IMU 645 may adjust one or more IMU parameters (e.g., sample rate). In some embodiments, data from the DCA 640 causes the IMU 645 to update an initial position of the reference point so it corresponds to a next position of the reference point. Updating the initial position of the reference point as the next calibrated position of the reference point helps reduce accumulated error associated with the current position estimated the IMU 645. The accumulated error, also referred to as drift error, causes the estimated position of the reference point to "drift" away from the actual position of the reference point over time. In some embodiments of the eyewear device 605, the IMU 645 may be a dedicated hardware component. In other embodiments, the IMU 645 may be a software component implemented in one or more processors.

The I/O interface 610 is a device that allows a user to send action requests and receive responses from the console 615. An action request is a request to perform a particular action. For example, an action request may be an instruction to start or end capture of image or video data, start or end the audio system 620 from producing sounds, start or end a calibration process of the eyewear device 605, or an instruction to perform a particular action within an application. The I/O interface 610 may include one or more input devices. Example input devices include: a keyboard, a mouse, a game controller, or any other suitable device for receiving action requests and communicating the action requests to the console 615. An action request received by the I/O interface 610 is communicated to the console 615, which performs an action corresponding to the action request. In some embodiments, the I/O interface 615 includes an IMU 645, as further described above, that captures calibration data indicating an estimated position of the I/O interface 610 relative to an initial position of the I/O interface 610. In some embodiments, the I/O interface 610 may provide haptic feedback to the user in accordance with instructions received from the console 615. For example, haptic feedback is provided when an action request is received, or the console 615 communicates instructions to the I/O interface 610 causing the I/O interface 610 to generate haptic feedback when the console 615 performs an action.

The console 615 provides content to the eyewear device 605 for processing in accordance with information received from one or more of: the eyewear device 605 and the I/O interface 610. In the example shown in FIG. 6, the console 615 includes a tracking module 650, an engine 655, and an application store 660. Some embodiments of the console 615 have different modules or components than those described in conjunction with FIG. 6. Similarly, the functions further described below may be distributed among components of the console 615 in a different manner than described in conjunction with FIG. 6.

The application store 660 stores one or more applications for execution by the console 615. An application is a group of instructions, that when executed by a processor, generates content for presentation to the user. Content generated by an application may be in response to inputs received from the user via movement of the eyewear device 605 or the I/O interface 610. Examples of applications include: gaming applications, conferencing applications, video playback applications, calibration processes, or other suitable applications.

The tracking module 650 calibrates the system environment 600 using one or more calibration parameters and may adjust one or more calibration parameters to reduce error in determination of the position of the eyewear device 605 or of the I/O interface 610. Calibration performed by the tracking module 650 also accounts for information received from the IMU 645 in the eyewear device 605 and/or an IMU 645 included in the I/O interface 610. Additionally, if tracking of the eyewear device 605 is lost, the tracking module 650 may re-calibrate some or all of the system environment 600.

The tracking module 650 tracks movements of the eyewear device 605 or of the I/O interface 610 using information from the one or more sensor devices 635, the IMU 645, or some combination thereof. For example, the tracking module 650 determines a position of a reference point of the eyewear device 605 in a mapping of a local area based on information from the eyewear device 605. The tracking module 650 may also determine positions of the reference point of the eyewear device 605 or a reference point of the I/O interface 610 using data indicating a position of the eyewear device 605 from the IMU 645 or using data indicating a position of the I/O interface 610 from an IMU 645 included in the I/O interface 610, respectively. Additionally, in some embodiments, the tracking module 650 may use portions of data indicating a position or the eyewear device 605 from the IMU 645 to predict a future location of the eyewear device 605. The tracking module 650 provides the estimated or predicted future position of the eyewear device 605 or the I/O interface 610 to the engine 655.

The engine 655 also executes applications within the system environment 600 and receives position information, acceleration information, velocity information, predicted future positions, audio information, or some combination thereof of the eyewear device 605 from the tracking module 650. Based on the received information, the engine 655 determines content to provide to the eyewear device 605 for presentation to the user. For example, if the received information indicates that the user has looked to the left, the engine 655 generates content for the eyewear device 605 that mirrors the user's movement in a virtual environment or in an environment augmenting the local area with additional content. Additionally, the engine 655 performs an action within an application executing on the console 615 in response to an action request received from the I/O interface 610 and provides feedback to the user that the action was performed. The provided feedback may be visual or audible feedback via the eyewear device 605 or haptic feedback via the I/O interface 610.

Additional Configuration Information

The foregoing description of the embodiments of the disclosure have been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An audio system comprising:

a microphone array that includes a plurality of acoustic sensors that are configured to detect sounds within a local area surrounding the microphone array, and at least some of the plurality of acoustic sensors are coupled to a near-eye display (NED);

a controller configured to:

estimate a direction of arrival (DoA) of a first detected sound of the detected sounds relative to a position of the NED within the local area, the estimate based on the detected sounds from the plurality of acoustic sensors;

generate one or more transfer functions based at least in part on the DoA estimation, the one or more transfer functions comprising a head-related transfer function (HRTF) for a user of the audio system;

update one of the one or more transfer functions based on position information received from an external system, the position information describing a position of the microphone array in the local area; and synthesize audio content based on the updated transfer function; and a speaker assembly configured to present the synthesized audio content to the user.

2. The audio system of claim 1, wherein the one or more transfer functions further comprise an array transfer function (ATF) associated with the microphone array.

3. The audio system of claim 1, wherein the controller is further configured to:

identify a source of the first detected sound relative to the position of the NED.

4. The audio system of claim 1, wherein at least one of the plurality of acoustic sensors is positioned inside an ear canal of a user.

5. The audio system of claim 1, wherein at least some of the plurality of acoustic sensors are positioned on a collar that is coupled to the NED and is configured to be positioned around a neck of a user.

6. The audio system of claim 1, wherein the controller is further configured to:

identify a second detected sound of the detected sounds;

estimate a second DoA of the second detected sound relative to a second position of the NED within the local area;

determine that the second detected sound has an associated parameter that is within a threshold value of a target parameter; and generate a second transfer function based on the second DoA estimation, the second transfer function associated with the second position of the NED within the local area.

7. The audio system of claim 1, wherein the controller is further configured to:

identify a second detected sound of the detected sounds;

estimate a second DoA of the second detected sound relative to a second position of the NED within the local area;

determine that the second detected sound has an associated parameter that is within a threshold value of a target parameter; and update a pre-existing transfer function based on the second DoA estimation, the pre-existing transfer function associated with the second position of the NED within the local area.

8. The audio system of claim 7, wherein the associated parameter describes a feature of the second detected sound, the feature selected from a group consisting of: frequency, amplitude, duration, and DoA.

9. The audio system of claim 1, further comprising:

a speaker assembly configured to provide audio content customized to the user based in part on the one or more transfer functions.

10. The audio system of claim 1, wherein the controller is further configured to determine the position of the NED based in part on at least one of the following:

depth information for the local area and inertial measurement unit (IMU) data for the NED.

11. The audio system of claim 10, wherein the depth information is from a depth camera assembly and the IMU data is from an IMU.

12. The audio system of claim 1, wherein the first detected sound is an environmental sound.

13. The system of claim 1, wherein the external system is one of:

a simultaneous localization and mapping system; and a depth camera assembly.

14. A method comprising:

detecting, by a microphone array that includes a plurality of acoustic sensors, sounds in a local area surrounding the microphone array, and at least some of the plurality of acoustic sensors are coupled to a near-eye display (NED);

estimating a direction of arrival (DoA) of a first detected sound of the detected sounds relative to a position of the NED within the local area, the estimate based on the detected sounds from the plurality of acoustic sensors;

generating one or more transfer functions based at least in part on the DoA estimation, the one or more transfer functions comprising a head-related transfer function (HRTF) for a user of the NED;

updating one of the one or more transfer functions based on position information received from an external system, the position information describing a position of the microphone array in the local area;

synthesizing audio content based on the updated transfer function; and presenting the synthesized audio content to the user.

15. The method of claim 14, wherein the one or more transfer functions further comprise an array transfer function (ATF) associated with the microphone array.

16. The method of claim 14, further comprising:

identifying a source of the first detected sound relative to the position of the NED.

17. The method of claim 14, wherein at least one of the plurality of acoustic sensors is positioned inside an ear canal of a user.

18. The method of claim 14, wherein at least some of the plurality of acoustic sensors are positioned on a collar that is coupled to the NED and is configured to be positioned around a neck of a user.

19. The method of claim 14, further comprising:

identifying a second detected sound of the detected sounds;

estimating a second DoA of the second detected sound relative to a second position of the NED within the local area;

determining that the second detected sound has an associated parameter that is within a threshold value of a target parameter; and generating a second transfer function based on the second DoA estimation, the second transfer function associated with the second position of the NED within the local area.

20. The method of claim 14, further comprising:

identifying a second detected sound of the detected sounds;

estimating a second DoA of the second detected sound relative to a second position of the NED within the local area;

determining that the second detected sound has an associated parameter that is within a threshold value of a target parameter; and updating a pre-existing transfer function based on the second DoA estimation, the pre-existing transfer function associated with the second position of the NED within the local area.

21. The method of claim 20, wherein the associated parameter describes a feature of the second detected sound, the feature selected from a group consisting of:

frequency, amplitude, duration, and DoA.

22. The method of claim 14, further comprising:

generating audio content customized to the user based in part on the one or more transfer functions.

23. The method of claim 14, further comprising:

determining the position of the NED based in part on at least one of the following: depth information for the local area and inertial measurement unit (IMU) data.

24. The method of claim 23, wherein the depth information is from a depth camera assembly and the IMU data is from an IMU.

25. The method of claim 14, wherein the first detected sound is an environmental sound.

26. A non-transitory computer-readable medium storing instructions that, when executed by one or more processors, cause the one or more processors to perform operations comprising:

detecting, by a microphone array that includes a plurality of acoustic sensors, sounds in a local area surrounding the microphone array, and at least some of the plurality of acoustic sensors are coupled to a near-eye display (NED);

estimating a direction of arrival (DoA) of a first detected sound of the detected sounds relative to a position of the NED within the local area, the estimate based on the detected sounds from the plurality of acoustic sensors;

generating one or more transfer functions based at least in part on the DoA estimation, the one or more transfer functions comprising a head-related transfer function (HRTF) for a user of the NED;

updating one of the one or more transfer functions based on position information received from an external system, the position information describing a position of the microphone array in the local area;

synthesizing audio content based on the updated transfer function; and presenting the synthesized audio content to the user.

* * * * *